US005378346A

United States Patent [19]

Ashiru, et al.

[11] Patent Number: 5,378,346

[45] Date of Patent: Jan. 3, 1995

[54] ELECTROPLATING

[76] Inventors: Oluwatoyin A. Ashiru, c/o International Tin Research Institute, Kinston Lane, Uxbridge, Middlesex UB8 3PJ, England; Stephen J. Blunden, 109 Twyford Road West Harrow, Middlesex HA2 OSJ, England

[21] Appl. No.: 969,183

[22] PCT Filed: Aug. 30, 1991

[86] PCT No.: PCT/GB91/01473

§ 371 Date: Oct. 12, 1993

§ 102(e) Date: Oct. 12, 1993

[87] PCT Pub. No.: WO92/04485

PCT Pub. Date: Mar. 19, 1992

[30] Foreign Application Priority Data

Aug. 31, 1990 [GB] United Kingdom ..... 9018984.6

Jun. 7, 1991 [GB] United Kingdom ..... 9112289.5

[51] Int. Cl.[6] ..... C25D 3/56

[52] U.S. Cl. ..... 205/244; 205/252; 205/253

[58] Field of Search ..... 205/244, 252, 253, 249; 106/1.05, 1.29, 1.25, 1.12

*Primary Examiner*—John Niebling

*Assistant Examiner*—Edna Wong

[57] ABSTRACT

Tin-zinc alloys can be electroplated from an aqueous alkaline solution containing an alkali metal zincate, an alkali metal stannate, and an alkali metal tartrate. The electroplating bath is alkaline with a pH of 11 to 14, preferably 12.0 to 13.5.

6 Claims, No Drawings

ELECTROPLATING

This invention is concerned with improvements in and relating to electroplating baths and to electroplating processes using the baths. In particular the invention is concerned with electroplating baths for the deposition of tin-zinc alloys.

Tin-zinc alloy deposits are recognised as a potential alternative to the toxic cadmium as corrosion resistant coatings. Tin-zinc coatings have proved to be useful in the radio industry and for the plating of components in the automobile and aircraft industries where their special properties, e.g. their good resistance to corrosion attack by hydraulic fluids, have been of great value. Other examples of the use of tin-zinc coatings include the protection of components for the electrical industry; the protection of hydraulic pit props; and as coatings for steel panels used in the construction industry.

At the present time, tin-zinc alloys are industrially plated from alkaline sodium or potassium stannate/cyanide baths as developed in the 1940's.

Since the mid-1960's the use of tin-zinc coatings has declined considerably. This may be partly because of the unpopularity of cyanide solutions and also probably owing to the fact that the tin-zinc cyanide plating baths are difficult to operate and require constant monitoring and control. For example, after plating for a few hours, the percentage of zinc deposited with tin starts to drop and this necessitates constant maintenance of the bath. Another possible reason for the decline in tin-zinc plating may be the fact that the matt tin-zinc finish is considered less attractive than a number of the bright finishes which are now becoming available.

It is also difficult to plate a wide range of alloy compositions from the same cyanide plating systems.

It is an object of the present invention to provide an improved electroplating bath for the electrodeposition of tin-zinc alloys.

Basically, a plating bath in accordance with the invention comprises an alkaline aqueous solution of three basic components, namely an alkali metal (sodium or potassium) zincate, an alkali metal (sodium or potassium) stannate and an alkali metal (sodium and/or potassium) tartrate. The invention also provides an electroplating process for the deposition of a tin/zinc alloy using the bath defined above.

The bath of the invention may be used for the electrodeposition of a tin-zinc alloy of any relative alloy composition (e.g. 0.05 to 99.95 wt. % of Zn) on any suitable conducting substrate, especially ferrous or copper alloys. The bath is suitable for use in rack, barrel and brush plating processes.

The desired proportions of tin and zinc in the deposited alloy are determined by the bath composition and the operating conditions during plating.

Tin-zinc alloys may be plated from the baths of the invention at current densities lower than the cyanide plating systems, with better cathode efficiency and with good covering and microthrowing powers. The deposits are ductile and have corrosion resistance properties which are superior to pure tin or pure zinc coatings and indeed, tin-zinc alloy deposits of equivalent composition obtained from the cyanide baths. The corrosion protection of the deposit is comparable to a cadmium deposit from a cyanide bath. The plating process gives a compact and fine grained deposit.

The baths of the invention are essentially solutions containing zinc and tin sources. The tin ions are introduced into the bath as sodium and/or potassium stannate. The stannate is the reservoir for the tin deposited at the cathode. Its concentration is not critical, but at low concentrations cathode efficiency is depressed and at high concentrations drag out and other losses will give higher operating costs.

The alkaline zinc source is preferably formed from a zinc oxide or from a suitable zinc salt or zinc metal and a strong base such as sodium or potassium hydroxide. The predominant source of the zinc ions in the bath is a zincate complex obtained from the reaction between the zinc oxide, salt or metal and the sodium or potassium hydroxide and is prepared as described below.

For easy control, the alkali hydroxide should preferably correspond to the stannate chosen: i.e. sodium hydroxide for the sodium stannate bath and potassium hydroxide for the potassium stannate bath. The alkali provides the hydroxide ion which is the principal conducting medium in the bath. A reservoir of this ion is also necessary to prevent the decomposition of the stannate by absorption of carbon dioxide from air. Furthermore, it is essential for good anode dissolution. The concentration of the free alkali should be adjusted to the appropriate value for the desired tin and zinc alloying proportion and the required application, e.g. rack, barrel, or brush plating. The chosen operating current density and temperature also play a role in the determination of the required amount of free alkali.

The alkali metal tartrate, preferably potassium sodium tartrate, is added to the bath to complex tin and to prevent hydrolysis and loss of tin from the bath as insoluble precipitate. The tartrate also serves to improve anode dissolution and, more importantly, gives a stable bath.

A variety of additives, both organic and inorganic, may be used to improve the quality of the deposit, and to give slightly brighter and more compact deposits.

There is an excess of alkali in the bath and thus the baths of the invention suitably have a pH of 11 to 14, preferably 12.0 to 13.5.

To produce an alloy deposit containing from about 2 percent to about 98 percent of zinc, the baths of the invention suitably had concentration ranges as noted below.

| | |
|---|---|
| Sodium based bath: | |
| Zinc (eg. added as zinc oxide) | 0.2–5 g/l |
| Sodium Hydroxide | 12–60 g/l |
| Tin (added as Sodium Stannate) | 30–80 g/l |
| Potassium Sodium Tartrate | 60–80 g/l |
| Potassium based bath: | |
| Zinc (eg. added as zinc oxide) | 0.3–5 g/l |
| Potassium Hydroxide | 20–60 g/l |
| Tin (added as Potassium Stannate) | 40–100 g/l |
| Potassium Sodium Tartrate | 60–100 g/l |

Suitable organic additives for the baths include hexamine, hexyl alcohol, ethanolamine, polyethylene glycol, propargyl alcohol and the like. These are suitably added in amounts of 0.005 to 35 g/l. The additives may be used alone or in combination. Suitable inorganic additives are alkali metal phosphates, especially trisodium phosphate, which are suitably added in amounts of 0.1 to 40 g/l.

A bath of the invention is suitably prepared by slurrying or dissolving the required amount of the zinc compound (preferably zinc oxide) in a minimal amount of water, preferably distilled or deionised water (Solution A). A very concentrated aqueous solution (typically about or more concentrated than 40 g/100 ml) of the required amount of sodium (or potassium) hydroxide is prepared in a separate container (Solution B).

Preferably, but not necessarily, before Solution B cools, it should be slowly added to Solution A with continuous stirring until all zinc oxide is dissolved and a clear solution is obtained. The resulting zincate solution is then left with continuous agitation to ensure complete homogeneity of the solution, e.g. for up to 30 minutes.

The actual plating tank is then part filled, e.g. to two-thirds its depth, with water, preferably distilled or deionised water, followed by the addition of the required amount of sodium (or potassium) stannate, with stirring, until all the stannate is dissolved (Solution C). Then the desired amount of potassium sodium tartrate is added to Solution C in the plating tank while stirring until a fairly clear solution is obtained. After this, the Solution A+B is added to Solution C. Distilled water is then added to the tank to make up to the working level. If the required amount of free alkali is present in the bath, no obvious precipitation should occur but the bath should still be filtered to remove all undissolved impurities. If however part of the stannate in the bath hydrolyses out as insoluble precipitate, the bath should be analysed for free alkali, tin and zinc metals in the solution. Then the deficient amount of free alkali should be added to the bath followed by tin (added as the stannate) and, if necessary, the zinc compound. If a semi-bright deposit is required, the specified additive, e.g. hexamine or trisodium phosphate, is added to the bath at this stage with stirring, in an amount sufficient to give the desired level of brightness. Excessive use of organic additives should be avoided.

As a precaution against stannite impurity (the alkaline form of tin(II) ion instead of the tin(IV) ion expected from a stannate bath) the freshly made-up solution may be oxidised before use by the addition of 10 ml. per liter of hydrogen peroxide (20 vol), introduced into the agitated bath from the bottom of the tank using a pipette or any other suitable device. This treatment should be given to the bath when necessary during operation.

The process of the invention is particularly useful for the plating of rolled steel and copper but the process can be used for varying sizes and shapes of articles such as: nuts, bolts, brackets, and complex shaped automobile components made of various metals together with weld and solder joints. The bath has detergent properties but good cleaning using standard cleaning procedures for the different metals is nevertheless necessary.

The bath can be operated from any insoluble anodes e.g. stainless or mild steel or graphite. In this case constant control and replenishment of tin and zinc ions in the solution is important. It is preferable to employ tin-zinc alloy anodes. Such anodes should be of the same composition as the alloy to be deposited and may be either in cast or rolled form. Alternatively, suitably controlled separate anodes of tin and/or zinc may be used. To ensure dissolution of tin in the stannic form, the tin-zinc or tin anodes should be maintained in filmed condition, (as in the deposition of tin from an alkaline stannate bath). The film may be established by polarising the anodes at sufficiently high current density or by inserting them slowly into the solution with current already flowing and after the cathode is already connected up in the bath and the plating circuit is complete.

The working temperature of the bath is conveniently from 60° to 75° C. This temperature range has been found to give optimum anode and cathode efficiency and also tends to give whiter deposits.

The bath is operated at low current densities of 0.3 to 2.5 amps per sq. dm. For barrel or brush plating current densities up to 3.5 amps. per sq. dm. or 5 amps per sq. dm., respectively, can be employed. However, in both these latter cases, the free alkali and metal containing salt contents of the bath should be adjusted to higher values.

Mild agitation of the bath during plating by mechanical movement of the work piece or any other stirring device is desirable as it improves cathode efficiency. Alternatively, the plating solution may be pumped to create turbulence.

Filtration of the plating solution, either continuously or at regular intervals, is also desirable. The quality of the deposit and in particular its smoothness is considerably enhanced by keeping the solution free of suspended impurities.

The cathode and anode current efficiencies of the bath of the invention are high, being 80 to 100 percent provided the recommended operating conditions are adhered to. The baths also exhibit good microthrowing and covering powers.

With properly adjusted working conditions the baths of the invention are very stable. A weekly check of free alkali in the bath is desirable but not crucial unless stannate starts to precipitate out. It has been established that when operated continuously for over 200 hours, or for three weeks duration of consistent usage of up to 8 hours a day, the constituents of the bath are still within specification and give the desired deposit composition and quality.

Other factors being constant, the composition of the deposit from a bath of the invention is found to depend more on the zinc content than on the tin content of the bath. An increase in tin content of the bath gives an increase in the tin content of deposited alloy. Also an increase in zinc content of the bath will give an increase in the zinc content of the deposit. An increase in free alkali content of the bath leads to a reduction in the tin content of the deposit. The tartrate in the bath when increased will slightly decrease the amount of zinc co-deposited with tin.

Temperature and current density have only a modest effect on the deposit composition if kept within the ranges noted above.

The tin-zinc deposit obtained in accordance with the invention is ductile and has good corrosion protection over a wide alloy concentration range (particularly 20 to 45% Zn), and with thickness as little as 6 micron as demonstrated by salt spray and humidity cabinet tests. The tests also showed that the deposits offer corrosion protection comparable to a cadmium deposit.

The deposits are compact, and fine grained with very few pores.

In order that the invention may be well understood the following Examples are given by way of illustration only. In the Examples all parts and percentages are by weight unless otherwise stated.

In the Examples all baths were prepared following the general procedure described above.

EXAMPLE 1

An aqueous electroplating bath was prepared containing 2.3 g/l of zinc oxide; 14 g/l sodium hydroxide; 165 g/l sodium stannate; and 65 g/l potassium sodium tartrate.

This electroplating bath was employed to deposit a tin-zinc alloy coating on a flat copper plate using standard rack plating procedure with mechanical agitation at 62°-68° C. The average cathodic current density was about 0.8 amp per sq dm.

Deposition was carried out for sufficient time to give a coating of approximately 10 to 10.5 μm. A compact, poreless, fine grained, and matt deposit with impressive appearance was obtained. The deposit had excellent adhesion and ductility. When analysed the alloy contained about 5% zinc.

EXAMPLE 2

A bath was prepared containing 2.7 g/l of zinc oxide; 15 g/l sodium hydroxide; 165 g/l sodium stannate; and 50 g/l potassium sodium tartrate.

The bath was employed to deposit a tin-zinc alloy coating on a flat copper plate using a standard rack plating procedure with mechanical agitation at 62°-68° C. The average cathodic current density was about 0.9 amp per sq dm.

Deposition was carried out for sufficient time to give a coating of approximately 14 to 15 μm. A compact, poreless, fine grained, and matt deposit with impressive appearance was obtained. The deposit had excellent adhesion and ductility. The alloy contained about 25% zinc.

EXAMPLE 3

A bath was prepared containing 3.5 g/l of zinc oxide; 56 g/l potassium hydroxide; 175 g/l potassium stannate; and 80 g/l potassium sodium tartrate.

The bath was employed to deposit a tin-zinc alloy coating on a flat copper plate using a standard rack plating procedure with mechanical agitation at 62°-68° C. The average cathodic current density was about 0.8 amp per sq. dm.

Deposition was carried out for sufficient time to give about 10 to 11 μm thick. A compact, poreless, fine grained, and matt depositions obtained; the alloy containing about 50% zinc.

EXAMPLE 4

A bath was prepared containing 4 g/l of zinc oxide; 40 g/l sodium hydroxide; 120 g/l sodium stannate; and 60 g/l potassium sodium tartrate.

The bath was employed to deposit a tin-zinc alloy onto a flat steel plate using a standard rack plating procedure with mechanical agitation at 62°-68° C. The average cathodic current density was about 0.9 amp per sq dm.

Deposition was carried out for sufficient time to give a coating of approximately 13 to 14 μm. A compact, poreless, fine grained, and matt deposit with impressive appearance was obtained. The deposit had excellent adhesion and ductility. The alloy contained about 80% zinc.

EXAMPLE 5

A bath was prepared containing 2.7 g/l of zinc oxide; 15 g/l sodium hydroxide; 165 g/l sodium stannate; and 50 g/l potassium sodium tartrate; 3 g/l trisodium phosphate; 2 g/l hexamine; and 8 g/l ethanolamine.

The bath was employed to deposit a tin-zinc alloy on a flat copper plate using a standard rack plating procedure with mechanical agitation at 62°-68° C. The average cathodic current density was about 0.8 amp per sq dm.

Deposition was carried out for sufficient time to give a coating of approximately 7 to 8 μm. A semi-bright deposit with impressive appearance was obtained. The deposit had excellent adhesion and ductility. The alloy contained about 25% zinc.

EXAMPLE 6

A bath was prepared containing 3.5 g/l of zinc oxide; 80 g/l potasssium hydroxide; 220 g/l potassium stannate; and 80 g/l potassium sodium tartrate. Bath operation now stays at room temperature and warmed up through the brush plating operating process to about 70° C.

The bath was employed to deposit a tin-zinc alloy on a steel pipe using a standard brush plating procedure with cathode rotation. The average cathodic current density was about 2 amp per sq dm.

Deposition was carried out for sufficient time to give a coating of approximately 12 μm. A compact, poreless, fine grained, and matt deposit with impressive appearance was obtained. The deposit had excellent adhesion and ductility. The alloy contained about 17% zinc.

EXAMPLE 7

A bath was prepared containing 3.5 g/l of zinc oxide; 64 g/l potassium hydroxide; 220 g/l potassium stannate; and 75 g/l potassium sodium tartrate.

The bath was employed to deposit a tin-zinc alloy coating on small steel samples using a standard barrel plating procedure at 62°-68° C. The average cathodic current density was about 2.5 amp per sq dm.

Deposition was carried out for sufficient time to give a coating of approximately 10 to 10.5 μm. A compact, poreless, fine grained, and matt deposit with impressive appearance was obtained. The deposit had excellent adhesion and ductility. The alloy contained about 20% zinc.

We claim:

1. A plating bath for the electrodeposition of tin-zinc alloys comprising an alkaline aqueous solution of (i) an alkali metal zincate, (ii) an alkali metal stannate and (iii) an alkali metal tartrate.

2. A plating bath as claimed in claim 1 in which the alkali metal zincate is sodium zincate, the alkali metal stannate is sodium stannate and the alkali metal tartrate is sodium potassium tartrate.

3. A plating bath as claimed in claim 1 in which the alkali metal zincate is potassium zincate, the alkali metal stannate is potassium stannate and the alkali metal tartrate is sodium potassium tartrate.

4. A plating bath as claimed in any one of the proceeding claims having a pH of from 11 to 14.

5. A plating bath as claimed in any one of the preceding claims also containing an alkali metal phosphate.

6. A method of electroplating a tin/zinc alloy onto a substrate using an electroplating bath as claimed in any one of the preceding claims.

* * * * *